US009457393B2

(12) United States Patent
Schardt et al.

(10) Patent No.: US 9,457,393 B2
(45) Date of Patent: Oct. 4, 2016

(54) FORMING MACHINE FOR FORGING, IN PARTICULAR, STRETCH-FORGING, WORKPIECES

(75) Inventors: Ernst Schardt, Mitwitz (DE); Herbert Ruger, Schneckenlohe (DE); Franz Suttan, Coburg (DE)

(73) Assignee: LANGENSTEIN & SCHEMANN GMBH, Coburg (DE)

( * ) Notice: Subject to any disclaimer, the term of this patent is extended or adjusted under 35 U.S.C. 154(b) by 1054 days.

(21) Appl. No.: 13/500,815

(22) PCT Filed: Oct. 5, 2010

(86) PCT No.: PCT/EP2010/064785

§ 371 (c)(1),
(2), (4) Date: May 16, 2012

(87) PCT Pub. No.: WO2011/042408

PCT Pub. Date: Apr. 14, 2011

(65) Prior Publication Data

US 2012/0266642 A1 Oct. 25, 2012

(30) Foreign Application Priority Data

Oct. 6, 2009 (DE) ..... 10 2009 048 428

(51) Int. Cl.
*B21J 9/12* (2006.01)
*B21J 7/14* (2006.01)
(Continued)

(52) U.S. Cl.
CPC .. *B21J 9/12* (2013.01); *B21J 7/14* (2013.01); *B21J 9/14* (2013.01); *B21J 13/03* (2013.01)

(58) Field of Classification Search
CPC ..... B21J 19/12; B21J 19/14; B21J 19/10; B21J 19/18; B21J 15/02; B21J 15/025; B21J 13/03; B21J 17/28; B21J 17/30; B21J 17/32; B30B 15/0052
USPC ..... 72/407
See application file for complete search history.

(56) References Cited

U.S. PATENT DOCUMENTS 2,666,292 A * 1/1954 Biggert, Jr. ..... 60/429
3,339,397 A * 9/1967 Othmar ..... 72/407
(Continued)

FOREIGN PATENT DOCUMENTS

DE 23 45 527 A1 3/1975
DE 23 45 528 A1 3/1975
(Continued)

OTHER PUBLICATIONS

Intl Search Rpt (English), Jan. 17, 2011.
(Continued)

*Primary Examiner* — Edward Tolan
*Assistant Examiner* — Mohammad Yusuf
(74) *Attorney, Agent, or Firm* — Miller Nash Graham & Dunn LLP; Kathleen T. Petrich

(57) ABSTRACT

A forming machine for forging metal workpieces which have been heated and/or are in a flowable condition including at least two forming tools (4A, 4B), at least one driving device for driving at least one of the forming tools in an approach motion (R) of the forming tools toward one another or in a return motion of the forming tools away from one another, and wherein the driving device comprises at least one eccentric element (22A, 22B) and at least one hydraulic drive element (11A, 11B), wherein the at least one hydraulic drive element (11A, 11B) is coupled hydraulically directly or indirectly to the eccentric element (22A, 22B) in such a way that an eccentric motion of the eccentric element produces a working motion of the hydraulic drive element by way of a hydraulic medium.

15 Claims, 2 Drawing Sheets

Figure 1:
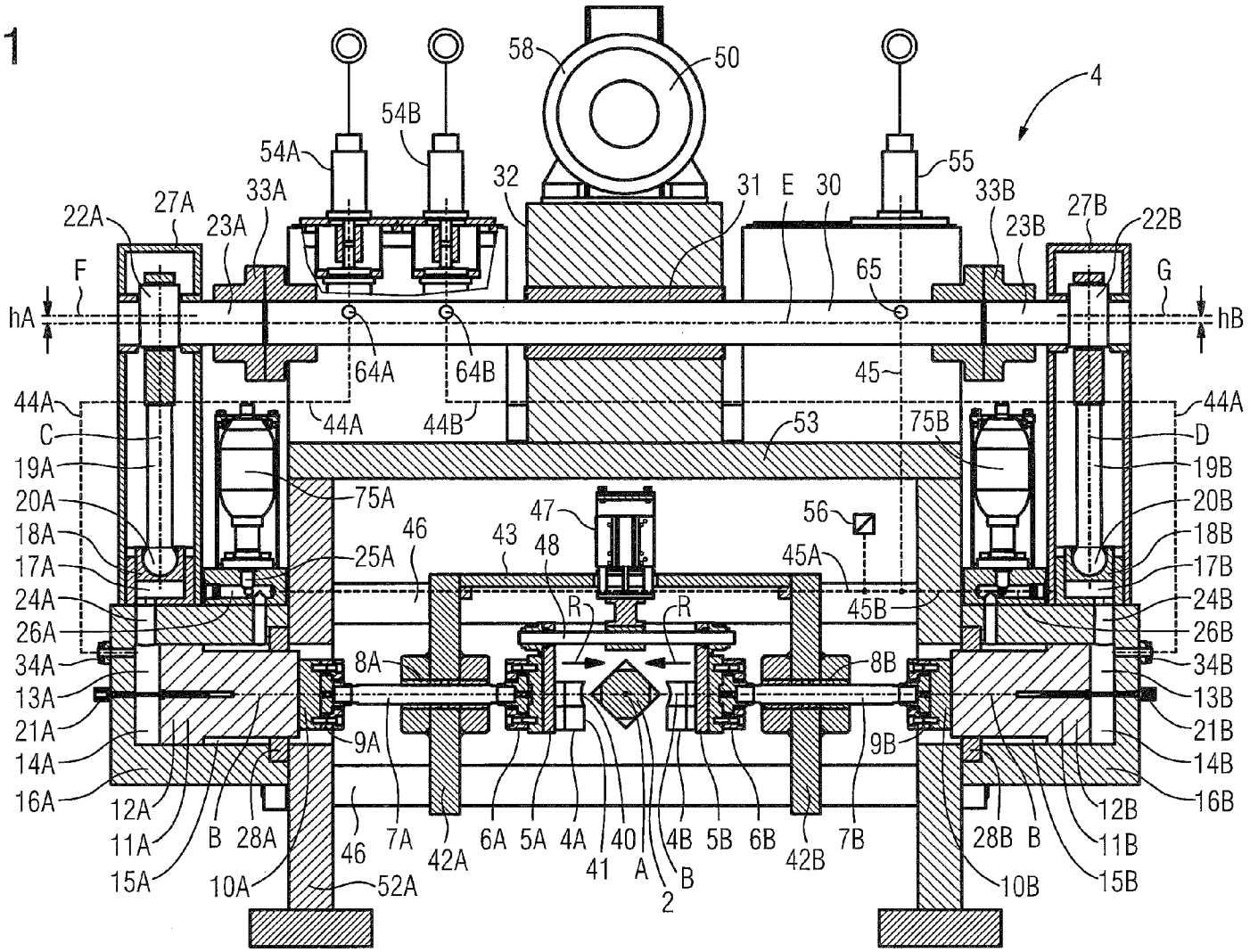

(51) Int. Cl.

| | |
|---|---|
| ***B21J 13/03*** | (2006.01) |
| ***B21J 9/14*** | (2006.01) |

(56) References Cited

U.S. PATENT DOCUMENTS

| | | | | | |
|---|---|---|---|---|---|
| 3,645,126 | A | * | 2/1972 | Kralowetz et al. | 72/402 |
| 3,681,966 | A | * | 8/1972 | Kralowetz et al. | 72/402 |
| 3,834,214 | A | * | 9/1974 | Kralowetz | 72/407 |
| 3,888,104 | A | * | 6/1975 | Ribback | 72/407 |
| 5,379,628 | A | * | 1/1995 | Pahnke et al. | 72/453.18 |
| 5,447,050 | A | * | 9/1995 | Pahnke | 72/453.02 |

FOREIGN PATENT DOCUMENTS

| | | | | |
|---|---|---|---|---|
| GB | 1456888 | | * | 11/1976 |
| JP | 60 177925 | A | | 9/1985 |
| JP | S63192528 | A | | 8/1988 |
| JP | H0790315 | B2 | | 10/1995 |
| SU | 820 975 | A1 | | 4/1981 |

OTHER PUBLICATIONS

PCT Int'l Preliminary Re-port on Patentability, Apr. 11, 2012, Langenstein & Schemann GmbH.

* cited by examiner

FORMING MACHINE FOR FORGING, IN PARTICULAR, STRETCH-FORGING, WORKPIECES

The invention relates to a forming machine for forging, in particular stretch-forging, workpieces.

Forging is a process for hot forming forgeable metal materials, in particular metal alloys such as steels. Stretch-forging, also referred to as drawing out or drawing for short, is a process belonging to the category of open-die forging, in which only a small part of the volume of the workpiece is formed between two drawing tools (or: drawing saddles) in successive forging steps. During stretch-forging, the workpiece is held at one end or at both ends, generally by gripping tongs of manipulators or robots, and is moved between the drawing tools in individual steps in a drawing direction and is then upset by the drawing tools perpendicularly to the drawing direction in partial areas that follow on from one another counter to the drawing direction. During this process, the material of the workpiece flows parallel to the drawing direction, and the workpiece thus becomes thinner in cross section perpendicularly to the drawing direction and longer parallel to the drawing direction. Generally, the drawing tools generally have somewhat spherical or convexly curved surfaces and are also referred to as stretching or drawing saddles, wherein the upper saddle is referred to as the top saddle and the lower saddle is referred to as the bottom saddle. The successive individual forming operations or "bites" leave behind on the workpiece a wavy structure with grooves which mirrors the shape of the saddles. The surface of the workpiece is therefore often smoothed in a subsequent operation using smoothing tools, which generally have larger dimensions than the drawing tools. Forging presses or forging hammers are generally used as forming machines for drawing, in which case the drawing tools are then provided on these machines. The top saddle is generally arranged on a movable upper tool carrier or top and the bottom saddle is generally arranged on a lower tool carrier, which is usually immobile, the anvil or press bed. However, it is also possible for both drawing tools to move. In order to reverse-forge an increase in width, which is generally unwanted when drawing the workpiece, the forging can be turned through 90° after each blow (or after each drawing pass). Stretch-forging or drawing is often used as a pre-shaping process or for preliminary distribution of the material before a closed-die forging operation, in which the workpiece is given its final form (in respect of this general prior art, see, for example, A. Herbert Fritz and Günter Schulze, "*vdi-Fertigungstechnik" [vdi Manufacturing Technology*], Springer-Verlag, 5$^{th}$ edition, 2001, pages 402 to 405).

Typically, rod-shaped or cuboidal blanks are lengthened axially in the stretch-forging process and, if required, are already provided with contours, as viewed in a longitudinal section in the drawing direction.

Both hydraulic drives and mechanical drives are known as drives for the upper and, where required, also the lower tool carrier.

It is the underlying object of the invention to indicate a new hydraulic forming machine, by means of which, in particular, short cycle times can be achieved.

According to the invention, this object is achieved by a forming machine having the features of patent claim 1. Advantageous embodiments and developments will become apparent from the patent claims dependent on patent claim 1.

The forming machine as claimed in patent claim 1 is suitable and intended for forging, in particular stretch-forging, metal workpieces which have been heated and/or are in a flowable condition, and comprises at least two forming tools, in particular drawing tools, at least one driving device for driving at least one of the forming tools in an approach motion of the forming tools toward one another or in a return motion of the forming tools away from one another, wherein the driving device comprises at least one eccentric element and at least one hydraulic drive element, in particular a drive piston, which drive element is coupled hydraulically to the eccentric element in such a way that the eccentric motion of the eccentric element produces a working motion of the hydraulic drive element by way of a hydraulic medium, and wherein the or each hydraulic drive element drives a forming tool in the working motion.

In a preferred embodiment, at least part of the hydraulic drive element is arranged in a hydraulic chamber filled with hydraulic medium, and the hydraulic chamber is partitioned or divided by the drive element into a front subchamber and a rear subchamber.

It is then expedient if a reset device is in each case assigned to the front subchamber of the hydraulic chamber for the purpose of resetting the drive element, wherein the reset device can, in particular, be a hydraulic reset device, in particular a reset device having a hydraulic pump which sets the hydraulic pressure in the front subchamber to at least one particular reset pressure value. However, a mechanical reset device with mechanical springs or the like is also possible.

In an advantageous embodiment, the rear subchamber of each hydraulic chamber is assigned a hydraulic setting device for the purpose of setting the end position, in particular the axial end position, of the drive element in the working motion, in particular by setting the supplied volume or pressure of the hydraulic medium in the rear subchamber. The hydraulic setting device generally comprises a hydraulic pump and a port on the rear subchamber and an associated hydraulic connection of the hydraulic pump to the port. The hydraulic pump is, in particular, a hydraulic servopump, e.g. an axial piston pump, and has a position-controlled servomotor, which holds the pump rotor or piston firmly in a predetermined position. The hydraulic pump is then expediently also used to fill the rear subchamber with the hydraulic medium.

In another embodiment, during its eccentric motion, the or each eccentric element drives a transmission element hydraulically coupled to the hydraulic drive element in a transmission motion. During the transmission motion, the transmission element moves backward and forward, in particular in the hydraulic chamber or in a stroke chamber hydraulically connected to the hydraulic chamber and likewise filled with the hydraulic medium, preferably in a substantially linear motion, wherein, in particular, the transmission element or the stroke chamber is hydraulically coupled or connected to the rear subchamber of the hydraulic chamber.

The driving device furthermore preferably comprises at least one electric drive motor, wherein the at least one eccentric element can be driven or is driven by the at least one drive motor via at least one drive shaft and rotates with the drive shaft in an eccentric motion eccentric with respect to the axis of rotation of the drive shaft.

In a special development, each forming tool is provided with an associated tool carrier, on which the forming tool is fixed, preferably releasably, and which is coupled for the purpose of driving to the associated hydraulic drive element. This coupling is achieved, in particular, through releasable connection of the tool carrier to a fixing flange, which is fixed on the end of a sliding rod which, preferably being guided and supported axially by an axial bearing, in turn has, at an end remote from this fixing flange, a further fixing flange, which, in turn, is releasably connected to an associated fixing flange at the front end of the drive element.

In a preferred variant, the forming tool is supported and guided on the associated tool carrier in a manner which allows it to be moved, in particular vertically and/or perpendicularly to the approach motion, or the tool carrier is appropriately configured in such a way that two parts can be moved relative to one another and one of these parts carries the forming tool. This is advantageous, in particular, in combination with an embodiment in which the forming tool has a, preferably upper, drawing surface and a, preferably lower, planishing surface and is then supported movably and can be fixed in two positions in order to arrange the drawing surface or the planishing surface in the operative position for the approach motion.

For the automation of this movement, an adjusting device for adjusting (and fixing) the forming tools into (in) various positions of displacement, in particular in the vertical direction and/or perpendicularly to the approach motion, is preferably provided. The adjusting device comprises, for example, a guide rod, which connects the two tool carriers to one another and which can be moved by means of a drive unit.

In a special embodiment, at least one or in each case one position measuring device is provided for measuring the position of the drive element, wherein the measured position is preferably used as a parameter for monitoring or controlling the forming process.

The forming machine according to the invention generally is or comprises a work-defined or travel-defined forming machine, preferably a forging hammer, in particular an upper hammer or counterblow hammer, or a forging press, i.e. the forming tools thereof operate either with a pressing or travel-defined action, on the one hand, or with a striking or work-defined action, on the other hand.

In addition to the forming machine according to the invention, a system according to the invention for forming, in particular stretch-forging, metal workpieces which have been heated and/or are in a flowable condition can also comprise at least one handling device for gripping a workpiece and preferably for performing a relative motion of the workpiece relative to the at least two forming tools of the forming machine.

Figure 2:
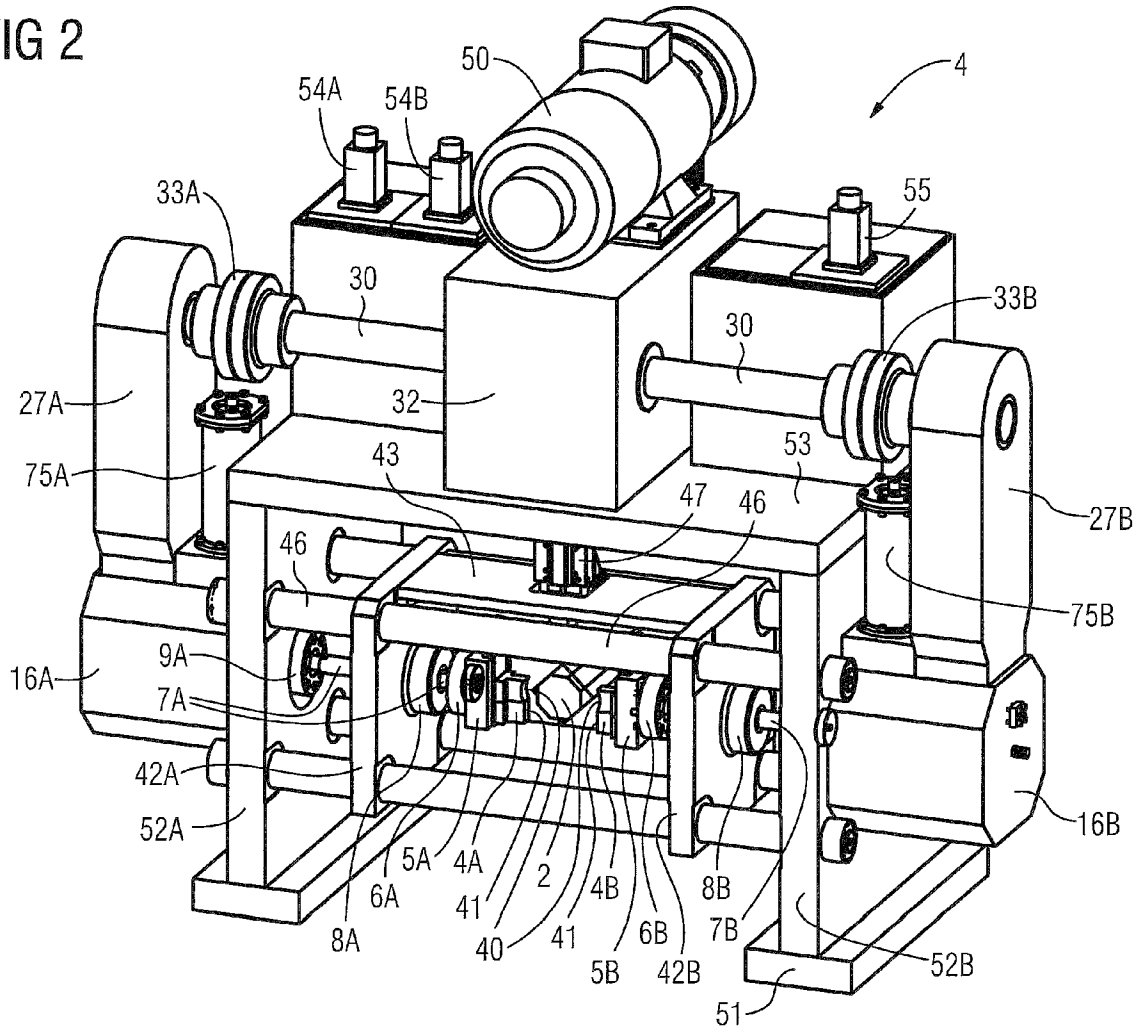

The invention is explained more fully below with reference to illustrative embodiments. In the process, reference is also made to the drawings, in which:

FIG. 1 shows a forming machine for forging, in particular stretch-forging workpieces in an embodiment according to the invention in a partially sectioned representation, and FIG. 2 shows the forming machine according to FIG. 1 in a perspective representation, each of the figures being schematic. Mutually corresponding components and dimensions are provided with the same reference signs in FIGS. 1 and 2.

FIGS. 1 and 2 show a forming machine 4 for forging, in particular stretch-forging or drawing, a metal workpiece 2, which is initially in the form of a, for example, cuboidal or polyhedral or cylindrical blank.

After having been heated in a furnace and thereby converted to a flowable condition for the purpose of hot forming, the blank or the workpiece 2 is gripped by one or two gripping devices (not shown) in a respective gripping area situated at one end of the workpiece 2 and is held in a position aligned along an axis A, which is a substantially horizontal position in the illustrative embodiments shown. The axis A extends along and, preferably centrally, through the workpiece 2.

If the forming machine is used for stretch-forging the workpiece 2, the at least one gripping device not only holds the workpiece 2 in the appropriate position along the axis A but moves the workpiece 2 axially or in a linear manner with respect to the axis A in individual axial path segments for successive working of the workpiece 2 in individual stretch-forging steps or drawing steps by means of drawing tools.

In the illustrative embodiment shown in FIGS. 1 and 2, two drawing tools 4A and 4B situated to the side of the horizontal axis A are provided, and these can be moved toward the workpiece 2 in a. drawing motion or approach motion R axially with respect to an axis B, which is aligned perpendicularly to the axis A and is likewise horizontal, and can act with a striking or pressing action on the workpiece 2 in order to form the latter and, after such a forming step, can be moved out of or back from the workpiece 2 in a return motion directed counter to the approach motion R.

In FIGS. 1 and 2, both drawing tools 4A and 4B are movable. However, it is also possible for just one of the two drawing tools 4A and 4B to be moved. Moreover, it is also possible for more than two drawing tools to be provided. The approach motion R does not have to be horizontal but can also be vertical or take place in an oblique direction, for example.

For each drawing tool 4A and 4B, the forming machine 4 comprises an associated tool carrier 5A and 5B, respectively, on which the drawing tool 4A or 4B is releasably fixed, and respective drives for driving the tool carrier 5A or 5B together with the tool 4A or 4B in the drawing motion R and in the opposite return motion.

Each drawing tool 4A and 4B has an upper drawing surface 40 and a lower planishing surface 41. With the drawing surfaces 40, the workpiece 2 is stretched and formed in its shape. The planishing surfaces 41 of the drawing tools 4A and 4B are used to smooth or planish the surface of the drawn workpiece 2 afterwards. In order to arrange the drawing surface 40 or the planishing surface 41 on the axis B provided for the drawing motion R, the drawing tool 4A or 4B is configured to allow movement, in particular vertical movement, relative to the tool carrier 5A and 5B or, alternatively, the tool carrier 5A and 5B is configured in such a way that two parts can be moved relative to one another and one of these parts carries the drawing tool 4A or 4B. For adjustment of the drawing tools 4A and 4B, in particular in the vertical direction, perpendicularly to the axis B, an adjusting device 47 is provided, comprising a guide rod 48 which connects the two tool carriers 5A and 5B to one another. The drawing tools 4A and 4B are fixed on the tool carriers 5A and 5B, which have a linear guide in the vertical direction. By means of the drive unit 47, which operates pneumatically, hydraulically or electromechanically, the tool carriers are moved upward or downward, depending on the desired mode of operation of the system (drawing or planishing). The vertical movement is introduced by means of the guide rod 48. The use of the guide rod 48 allows the approach motion R. The two tool carriers 5A and 5B can be locked in each of the two end positions. This locking system can be driven hydraulically or pneumatically.

The adjusting device 47 is fixed on a transverse plate 43 which, in turn, is fixed laterally on two vertically extending holding plates 42A and 42B. The structure comprising the holding plates 42A and 42B and the transverse plate 43 is reinforced and stabilized by four rod-shaped fixing elements 46 and delimits the actual working zone of the forming machine. The four fixing elements 46 are fixed on vertical stand plates 52A and 52B of a surrounding stand 51, said plates standing on the ground via stand feet. Extending above the transverse plate 43 and the adjusting device 47 is a transversely extending horizontal stand plate 53 of the stand 51.

Each tool carrier 5A and 5B is connected releasably, by means of screws for example, to a fixing flange 6A or 6B, which is fixed on the end of a sliding rod 7A or 7B which, in turn, is guided and supported axially on the holding plate 42A or 42B by an axial bearing 8A or 8B. At the end remote from the fixing flange 6A and 6B, a further fixing flange 9A and 9B is provided on each sliding rod 7A or 7B, said fixing flange, in turn, being releasably connected to an associated fixing flange 10A or 10B at the front end of a hydraulic drive piston 11A or 11B, once again by means of screws for example.

It would also be conceivable, in the case of certain sizes of machine, for the tool carriers 5A and 5B to be screwed directly to the fixing flanges 10A and 10B and to dispense completely with the guide system with the holding plates 42A and 42B.

The hydraulic drive piston 11A or 11B can be moved and is guided axially with respect to the axis B in an associated hydraulic chamber 13A or 13B. A piston component 12A or 12B divides a front subchamber 15A or 15B from a rear subchamber 14A or 14B of the hydraulic chamber 13A or 13B and is guided in a sealed manner against the inner wall of the hydraulic chamber 13A or 13B. During a forward motion of the drive piston 11A or 11B along the axis B in the direction of the approach motion R, the rear subchamber 14A or 14B increases in size, and the front subchamber 15A or 15B decreases in size, and the situation is reversed during the return motion, which is directed counter to the approach motion R.

The position of the drive piston 11A or 11B within the hydraulic chamber 13A or 13B can be measured by means of an associated position measuring device 21A or 21B and can thus be used as a parameter for monitoring or controlling the forming process.

The front subchamber 15A or 15B is sealed off from the outer surface of the drive piston 11A or 11B by a seal 28A or 28B, wherein it is also possible for the seal 28A or 28B additionally to have the function of a bearing for the drive piston 11A or 11B. In general, the seal does not assume the sealing function. For this purpose, either an additional guide strip made of plastic or a guide bushing, made of bronze for example, is used, and this can also accommodate the seal, for example.

The rear subchamber 14A or 14B is in fluid communication with an associated stroke chamber 17A or 17B via a rear connecting duct 24A or 24B. The front subchamber 15A or 15B of the hydraulic chamber 13A or 13B is in fluid communication with an intermediate chamber 26A or 26B via a front connecting duct 25A or 25B, said chamber in turn being in fluid communication with a compensation tank or pressure accumulator 75A or 75B.

Subchambers 14A and 14B and subchambers 15A and 15B of the hydraulic chambers 13A and 13B, the stroke chambers 17A and 17B and intermediate chambers 26A and 26B, and connecting ducts 24A and 24B and connecting ducts 25A and 25B are all filled with a hydraulic medium, in particular a hydraulic oil or some other well suited pressure-resistant and virtually incompressible hydraulic medium.

Moving in each stroke chamber 17A or 17B is an associated reciprocating piston 18A or 18B, which is coupled by a joint 20A or 20B to one end of a reciprocating rod 19A or 19B as a transmission element. The reciprocating rod 19A or 19B is coupled at the other end to an eccentric element 22A or 22B.

The eccentric element 22A or 22B is arranged for conjoint rotation on an associated rotary shaft 23A or 23B and is supported eccentrically with respect to an axis of rotation E of the rotary shaft 23A or 23B. An eccentric axis F or G of the eccentric element 22A or 22B is spaced apart from the axis of rotation E by an appropriate eccentric distance hA or hB, resulting in a corresponding maximum stroke of 2·hA or 2·hB of the reciprocating piston 18A or 188 coupled to the eccentric element 22A or 22B by the reciprocating rod 19A or 19B during one complete revolution of the eccentric element 22A or 22B. The reciprocating motion of the reciprocating piston 18A or 18B takes place in a linear manner along a stroke axis C or D, which is perpendicular to the axis of rotation E and the eccentric axes F and G.

In the illustrative embodiment shown, the axes of rotation of the two rotary shafts 23A and 23B coincide on a common axis of rotation E, even though this is not necessarily the case. Moreover, the two rotary shafts 23A and 23B are driven by a common central rotary shaft 30 via respective couplings 33A and 33B, preferably in synchronism. Rotary shaft 30 likewise rotates about the common axis of rotation E and is driven by a central rotary drive 50, which is arranged on and/or in a housing 32 which, in turn, is supported and arranged on the stand plate 53. Rotary shaft 30 is supported within the housing 32 in a rotary bearing 31 designed as a transmission hollow shaft. The rotary drive 50 comprises an electric drive motor 58, which, in particular, can be a servomotor or permanent magnet motor and/or torque motor or asynchronous motor, and a transmission, which is arranged in the housing 32 and by means of which the drive motor 58 drives rotary shaft 30. By virtue of this arrangement, the two rotary shafts 23A and 23B and hence the eccentric elements 22A and 22B and, finally, the reciprocating pistons 18A and 18B move in synchronism with respect to one another, this in turn having the effect that both drive, pistons 11A and 11B move simultaneously forward in the approach motion R or rearward in the return motion owing to the hydraulic coupling with the reciprocating pistons 18A and 18B, that is to say the two tools 4A and 4B are fed simultaneously toward the workpiece 2 or retracted simultaneously from the workpiece 2. It would also be conceivable to design the entire rotary drive 50, together with the drive motor 58 and the transmission 32, as an "underfloor drive" and to arrange these units together with the eccentric elements 22A and 22B below the axis B.

The volumes of the stroke chambers 17A and 17B and of the rear subchambers 14A and 14B of the hydraulic chambers 13A and 13B are matched to one another, with the result that the stroke 2·hA or 2·hB of the reciprocating piston 18A or 18B preferably corresponds to the total stroke or total deflection of the drive piston 11A or 11B and hence of the tools 4A and 4B in the working motion.

The rear subchambers 14A and 14B of the hydraulic chambers 13A and 13B are furthermore connected to a hydraulic pump 64A or 64B by a respective port 34A or 34B and an associated hydraulic connection 44A or 44B. The hydraulic pumps 64A and 64B are, in particular, hydraulic servopumps, e.g. axial piston pumps, driven by position-controlled servomotors 54A and 54B, which hold the pump rotors or pistons firmly in position, having a hydraulic compensation reservoir. The hydraulic pump 64A or 64B serves, on the one hand, to fill the rear subchamber 14A or 14B with the hydraulic medium and, on the other hand, for fixing the axial end position of the drive piston 11A or 11B in the hydraulic chamber 13A or 13B and hence also the position of the tools 4A and 4B. If the hydraulic pumps 64A or 64B keep or introduce more hydraulic medium in or into the associated rear subchamber 14A or 14B by building up a corresponding hydraulic pressure, the end position of the drive piston 11A or 11B shifts forward and vice versa.

Finally, a further hydraulic pump 65 is provided, which is connected to a hydraulic connection 45, in which a pressure measuring device 56 is arranged and which divides into two parallel branches 45A and 45B, each of the two branches 45A and 45B being connected to one of the intermediate chambers 26A or 26B. The hydraulic pump 65 is thus also coupled hydraulically to the front subchamber 15A or 15B of the hydraulic chamber 13A or 13B and preferably serves as a reset device for exerting a resetting force on the associated drive piston (11A, 11B) by virtue of the hydraulic pressure in the front subchamber 15A or 15B, and thus in practice sets the preload on the drive piston 11A or 11B. Instead of such a hydraulic reset device, it would also be possible to provide a purely mechanical reset device, e.g. a spring or the like.

LIST OF REFERENCE SIGNS

2 workpiece
4 forming machine
4A, 4B drawing tool
5A, 5B tool carrier
6A, 6B fixing flange
7A, 7B sliding rod
8A, 8B axial bearing
9A, 9B fixing flange
10A, 10B fixing element
11A, 11B drive piston
12A, 12B piston component
13A, 13B hydraulic chamber
14A, 14B rear subchamber
15A, 15B front subchamber
16A, 16B housing
17A, 17B stroke chamber
18A, 18B reciprocating piston
19A, 19B reciprocating rod
20A, 20B joint
21A, 21B position measuring device
22A, 22B eccentric element
23A, 23B rotary shaft
24A, 24B rear connecting duct
25A, 25B front connecting duct
26A, 26B intermediate chamber
27A, 27B housing
28A, 28B seal
30 rotary shaft
31 rotary bearing
32 housing
33A, 33B coupling
34A, 34B port
40 drawing surface
41 planishing surface
42A, 42B holding plate
43 transverse plate
44A, 44B hydraulic connection
45 hydraulic connection
45A, 45B branch
46 fixing rods
47 adjusting device
48 connecting rod
50 rotary drive
51 stand
52A, 52B stand plate
53 stand plate
54A, 54B servomotor
55 servomotor
56 pressure measuring device
58 drive motor
64A, 64B hydraulic pump
65 hydraulic pump
75A, 75B pressure accumulator
A workpiece axis
B approach axis
C, D stroke axis
E axis of rotation
F, G eccentric axis
hA, hB eccentric distance
R approach motion

The invention claimed is:

1. A forming machine for forging, in particular stretch-forging, metal workpieces, which have been heated and/or are in flowable condition, comprising a) at least two forming tools (4A, 4B), b) at least one driving device for driving at least one of the forming tools in an approach motion (R) of the forming tools toward one another or in a return motion of the forming tools away from one another, c) wherein the driving device comprises at least one eccentric element (22A, 22B) and at least one hydraulic drive element (11A, 11B), d) wherein the at least one hydraulic drive element (11A, 11B) is coupled hydraulically directly or indirectly to the eccentric element (22A, 22B) in such a way that an eccentric motion of the eccentric element produces a working motion of the hydraulic drive element by way of a hydraulic medium, and e) wherein the at least one hydraulic drive element (11A, 11B) is coupled to the at least one forming tools (4A, 4B) and, in the working motion thereof, drives the at least one forming tool, f) in which at least part of the hydraulic drive element (11A, 11B is arranged in a hydraulic chamber (13A, 13B) filled with hydraulic medium and divides the hydraulic chamber (13A, 13B) into a front subchamber (15A, 15B) and a rear subchamber (14A, 14B), g) in which the rear subchamber (14A, 14B) of each hydraulic chamber is assigned a hydraulic setting device (C64A, 64B, 54A, 54B, 34A, 34B) for setting an end position of the hydraulic drive element (11A, 11B) in the working motion, by setting a supplied volume or pressure of the hydraulic medium in the rear subchamber (14A, 14B), wherein the hydraulic setting device has a hydraulic pump (64A, 64B) and a port (34A, 34B) on the rear subchamber (14A, 14B) and an associated hydraulic connection (44A, 44B) of the hydraulic pump (64A, 64B) to the port (34A, 34B), h) wherein the hydraulic pump (64A, 64B) is a hydraulic servopump and has a position-controlled servomotor (54A, 548), which holds the at least one hydraulic drive element firmly in position, i) wherein the front subchamber (15A, 15B) is in fluid communication with an intermediate chamber (26A, 26B) via a front connecting duct (25A, 25B), said chamber in turn being in fluid communication with a reset device (65, 75A, 75B), wherein the reset device (65, 75A, 75B) is connected to a hydraulic connection (45), in which a pressure measuring device (56) is arranged and which divides into two parallel branches (45A, 45B), each of the two branches (45A, 45B) being connected to one of the intermediate chambers (26A, 26B) in such way that the reset device (65, 75A, 75B) is coupled hydraulically to the front subchamber (15A, 15B) for exerting a resetting force on the associated hydraulic drive element (11A, 11B).

2. The forming machine as claimed in claim 1, in which the hydraulic pump (64A, 64B) is used to fill the rear subchamber (14A, 14B) with the hydraulic medium.

3. The forming machine according to claim 1, in which, during its eccentric motion, the at least one eccentric element (22A, 22B) drives a transmission element (18A, 18B) hydraulically coupled to the hydraulic drive element in a transmission motion, wherein, in particular, the transmission element moves backward and forward, during the transmission motion, in the hydraulic chamber or in a stroke chamber (17A, 17B) hydraulically connected to the hydraulic chamber and likewise filled with the hydraulic medium, preferably in a substantially linear motion, and wherein the transmission element (18A, 18B) or the stroke chamber (17A, 17B) is hydraulically coupled or connected to the rear subchamber (14A, 14B) of the hydraulic chamber.

4. The forming machine according to claim 1, in which the driving device comprises at least one electric drive motor (58), wherein the at least one eccentric element is driven or is driven by the at least one drive motor via at least one drive shaft (30, 23A, 23B) and rotates with the drive shaft in an eccentric motion eccentric with respect to the axis of rotation (E) of the drive shaft.

5. The forming machine according to claim 1, in which each forming tool (4A, 4B) is provided with an associated tool carrier (5A, 5B), on which the forming tool (4A, 4B) is fixed, preferably releasably, and which is coupled for driving the associated hydraulic drive element (11A, 11B), wherein the coupling is achieved through a releasable connection of the tool carrier (5A, 5B) to a fixing flange (6A, 6B), which is fixed on an end of a sliding rod (7A, 7B) which, being guided and supported axially by an axial bearing (8A, 8B), in turn has, at an end remote from the fixing flange (6A, 6B), a further fixing flange (9A, 9B), which, in turn, is releasably connected to an associated fixing flange (10A, 10B) at a front end of the hydraulic drive element (11A, 11B).

6. The forming machine according to claim 5, in which the forming tool (4A, 4B) is supported and guided on the associated tool carrier (5A, 5B) in a manner which allows it to be moved vertically and/or perpendicularly to the approach motion (R), or the tool carrier (5A, 5B) is configured in such a way that two parts are moved relative to one another and one of the two parts carries the forming tool (4A, 4B), wherein an adjusting device (47) for adjusting the forming tools (4A, 4B) into various positions of displacement in the vertical direction and/or perpendicularly to the approach motion (R), is provided, comprising a guide rod (48), which connects the two tool carriers (5A, 5B) to one another and which are moved by means of a drive unit (47).

7. A forming machine for forging a metal workpiece that has been heated and/or are in a flowable condition, comprising:

a) at least two forming tools (4A, 4B);

b) at least one driving device for driving at least one of the forming tools in an approach motion (R) of the forming tools toward one another or in a return motion of the forming tools away from one another;

c) wherein the driving device comprises at least one eccentric element (22A, 22B) and at least one hydraulic drive element (11A, 11B);

d) wherein the at least one hydraulic drive element (11A, 11B) is coupled hydraulically directly or indirectly to the eccentric element (22A, 22B) such that the resulting eccentric motion of the eccentric element produces a working motion of the hydraulic drive element by way of a hydraulic medium;

e) wherein the at least one hydraulic drive element (11A, 11B) is coupled to the at least one forming tools (4A, 4B) and, in the working motion thereof, drives the at least one forming tool;

f) wherein the at least one forming tool (4A, 4B) has an upper drawing surface (40) and a lower planishing surface (41) and is movably supported and fixed in two positions to arrange the drawing surface (40) or the planishing surface (41) in an operative position (B) for the approach motion (R), g) wherein at least part of the hydraulic drive element (11A, 11B) is arranged in a hydraulic chamber (13A, 13B) filled with hydraulic medium and divides the hydraulic chamber (13A, 13B) into a front subchamber (15A, 15B) and a rear subchamber (14A, 14B), wherein a reset device (65, 75A, 75B) is assigned to the front subchamber (15A, 15B) for resetting the drive element (11A, 11B), wherein the reset device is a hydraulic reset device (65, 75A, 75B), said hydraulic reset device (65, 75A, 75B) being connected to a hydraulic connection (45), in which a pressure measuring device (56) is arranged and which divides into two parallel branches (45A, 45B) being connected to one of the intermediate chambers (26A, 26B) in such way that the reset devices (65, 75A, 75B) is coupled hydraulically to the front subchamber (15A, 15B) and wherein the reset device has a hydraulic pump that sets the hydraulic pressure in the front chamber (15a, 15B) to at least one particular reset pressure value.

8. The forming machine according to claim 7 wherein the rear subchamber (14A, 14B) of each hydraulic chamber is assigned a hydraulic setting device (64A, 64B, 54A, 54B, 34A, 34B) for setting an end position of the hydraulic drive element (11A, 11B) in the working motion by setting a supplied volume or pressure of the hydraulic medium in the rear subchamber.

9. The forming machine according to claim 8, wherein the hydraulic setting device has a hydraulic pump (64A, 64B) and a port (34A, 34B) on the rear subchamber (14A, 14B) and an associated hydraulic connection (44A, 44B) of the hydraulic pump (64A, 64B) to the port (34A, 34B), wherein the hydraulic pump (64A, 64B) is a hydraulic servopump.

10. A forming machine for forging, in particular stretch-forging, metal workpieces, which have been heated and/or are in flowable condition, comprising a) at least two forming tools (4A, 4B), b) at least one driving device for driving at least one of the forming tools in an approach motion (R) of the forming tools toward one another or in a return motion of the forming tools away from one another, c) wherein the driving device comprises at least one eccentric element (22A, 22B) and at least one hydraulic drive element (11A, 11B), d) wherein the at least one hydraulic drive element (11A, 11B) is coupled hydraulically directly or indirectly to the eccentric element (22A, 22B) in such a way that an eccentric motion of the eccentric element produces a working motion of the hydraulic drive element by way of a hydraulic medium, and e) wherein the at least one hydraulic drive element (11A, 11B) is coupled to the at least one forming tools (4A, 4B) and, in the working motion thereof, drives the at least one forming tool, f) wherein at least part of the hydraulic drive element (11A, 1 lB is arranged in a hydraulic chamber (13A, 13B) filled with hydraulic medium and divides the hydraulic chamber (13A, 13B) into a front subchamber (15A, 15B) and a rear subchamber (14A, 14B), g) wherein the rear subchamber (14A, 14B) of each hydraulic chamber is assigned a hydraulic setting device (C64A, 64B, 54A, 54B, 34A, 34B) for setting an end position of the hydraulic drive element (11A, 11B) in the working motion, by setting a supplied volume or a pressure of the hydraulic medium in the rear subchamber (14A, 14B), wherein the hydraulic setting device has at leasr one hydraulic pump (64A, 64B) and a corresponding port (34A, 34B) on the rear subchamber (14A, 14B) and an associated hydraulic connection (44A, 44B) of the at least one hydraulic pump (64A, 64B) to the corresponding port (34A, 34B), h) wherein the hydraulic pump (64A, 64B) is a hydraulic servopump and has a position-controlled servomotor (54A, 548), which holds the at least one hydraulic drive element firmly in position, and i) wherein the hydraulic pump (64A, 64B) keeps more hydraulic medium in the associated rear subchamber (14A, 14B) by building up a corresponding hydraulic pressure to shift the end position of the hydraulic drive element (11A, or 11B) forward and vice versa, wherein each forming tool (4A, 4B) is fixed releasably and coupled for driving the associated hydraulic drive element (11A, 11B), wherein the coupling is achieved through a releasable connection of the tool carrier (5A, 5B) to a fixing flange (6A, 6B), which is fixed on an end of a sliding rod (7A, 7B) which, being guided and supported axially by an axial bearing (8A, 8B), in turn has, at an end remote from the fixing flange (6A, 6B), a further fixing flange (9A, 9B), which, in turn, is releasably connected to an associated fixing flange (10A, 10B) at a front end of the hydraulic drive element (11A, 11B), wherein the forming tool (4A, 4B) is supported and guided on the associated tool carrier (5A, 5B) in a manner which allows it to be moved vertically and/or perpendicularly to the approach motion (R), or the tool carrier (5A, 5B) is configured in such way that two parts are moved relative to one another and one of the two parts carries the forming tool (4A, 4B), wherein an adjusting device (47) for adjusting the forming tools (4A, 4B) into various positions of displacement in the vertical direction and/or perpendicularly to the approach motion (R), is provided, comprising a guide rod (48), which connects the two tool carriers (5A, 5B) to one another and which are moved by means of the adjusting device (47) which is fixed on a transverse plate (43) which, in turn, is fixed laterally on two vertically extending holding plates (42A, 42B), wherein the holding plates (42A, 42B) and/or the transverse plate (43) is reinforced and stabilized by fixing elements (46) which are fixed to a stand (51) of the forming machine.

11. The forming machine as claimed in claim 10, in which the hydraulic pump (64A, 64B) is used to fill the rear subchamber (14A, 14B) with the hydraulic medium.

12. The forming machine according to claim 10, in which, during its eccentric motion, the at least one eccentric element (22A, 22B) drives a transmission element (18A, 18B) hydraulically coupled to the hydraulic drive element in a transmission motion, wherein, in particular, the transmission element moves backward and forward, during the transmission motion, in the hydraulic chamber or in a stroke chamber (17A, 17B) hydraulically connected to the hydraulic chamber and likewise filled with the hydraulic medium, preferably in a substantially linear motion, and wherein the transmission element (18A, 18B) or the stroke chamber (17A, 17B) is hydraulically coupled or connected to the rear subchamber (14A, 14B) of the hydraulic chamber.

13. The forming machine according to claim 10, in which the driving device comprises at least one electric drive motor (58), wherein the at least one eccentric element is driven or is driven by the at least one drive motor via at least one drive shaft (30, 23A, 23B) and rotates with the drive shaft in an eccentric motion eccentric with respect to the axis of rotation (E) of the drive shaft.

14. The forming machine according to claim 10, in which each forming tool (4A, 4B) is provided with an associated tool carrier (5A, 5B), on which the forming tool (4A, 4B) is fixed, preferably releasably, and which is coupled for driving the associated hydraulic drive element (11A, 11B), wherein the coupling is achieved through a releasable connection of the tool carrier (5A, 5B) to a fixing flange (6A, 6B), which is fixed on an end of a sliding rod (7A, 7B) which, being guided and supported axially by an axial bearing (8A, 8B), in turn has, at an end remote from the fixing flange (6A, 6B), a further fixing flange (9A, 9B), which, in turn, is releasably connected to an associated fixing flange (10A, 10B) at a front end of the hydraulic drive element (11A, 11B).

15. The forming machine according to claim 14, in which the forming tool (4A, 4B) is supported and guided on the associated tool carrier (5A, 5B) in a manner which allows it to be moved vertically and/or perpendicularly to the approach motion (R), or the tool carrier (5A, 5B) is configured in such a way that two parts are moved relative to one another and one of the two parts carries the forming tool (4A, 4B), wherein an adjusting device (47) for adjusting the forming tools (4A, 4B) into various positions of displacement in the vertical direction and/or perpendicularly to the approach motion (R), is provided, comprising a guide rod (48), which connects the two tool carriers (5A, 5B) to one another and which are moved by means of a drive unit (47).

* * * * *